US008731801B2

(12) United States Patent
Mowery

(10) Patent No.: US 8,731,801 B2
(45) Date of Patent: May 20, 2014

(54) FUEL INJECTOR HEATER ELEMENT CONTROL VIA SINGLE DATA LINE

(75) Inventor: Kenneth D. Mowery, Noblesville, IN (US)

(73) Assignee: Delphi Technologies, Inc., Troy, MI (US)

( * ) Notice: Subject to any disclaimer, the term of this patent is extended or adjusted under 35 U.S.C. 154(b) by 562 days.

(21) Appl. No.: 13/106,220

(22) Filed: May 12, 2011

(65) Prior Publication Data

US 2012/0285424 A1 Nov. 15, 2012

(51) Int. Cl.
*F02M 53/02* (2006.01)
*F02M 53/06* (2006.01)
*F02G 5/00* (2006.01)

(52) U.S. Cl.
USPC ..... 701/103

(58) Field of Classification Search
USPC ..... 701/103–105, 101, 102, 115; 123/543, 123/549, 552; 239/128, 135, 5; 73/114.45, 73/114.58, 114.61
See application file for complete search history.

(56) References Cited

U.S. PATENT DOCUMENTS 5,401,935 A * 3/1995 Smith et al. ..... 219/206
5,936,520 A 8/1999 Luitje et al.
5,982,048 A 11/1999 Fendt et al.
6,688,533 B2 * 2/2004 Nines et al. ..... 239/5
7,516,733 B2 * 4/2009 Stephan et al. ..... 123/445
7,980,222 B2 * 7/2011 Stephan et al. ..... 123/445
8,439,018 B2 * 5/2013 Kabasin et al. ..... 123/549
2007/0167086 A1 7/2007 Tolli
2008/0315934 A1 12/2008 Engl

OTHER PUBLICATIONS

U.S. Appl. No. 12/773,251, Kabasin, et al., filed May 4, 2010.

* cited by examiner

*Primary Examiner* — Hieu T Vo
(74) *Attorney, Agent, or Firm* — Lawrence D. Hazelton

(57) ABSTRACT

A system, heated fuel injector, and controller for closed-loop temperature control of a heated fuel injector having simultaneous two-way data communication over a single-line data connection. The system includes a voltage source to output a heater enable signal and a variable current sink configured to draw a current value indicative of a temperature value related to the heated fuel injector. The heater signal and the current value are simultaneously present on the single-line data connection. The configuration reduces the effect of ground shift on the accuracy of determining a feedback signal from the heated fuel injector. The feedback signal is a temperature value related to the heated fuel injector and is indicated by a current value. Because the feedback signal is a current value, the feedback signal is generally immune from being influenced by ground shift between the controller and the heated fuel injector.

14 Claims, 2 Drawing Sheets

FUEL INJECTOR HEATER ELEMENT CONTROL VIA SINGLE DATA LINE

TECHNICAL FIELD OF INVENTION

The invention generally relates to closed-loop temperature control of a heater element in a heated fuel injector, and more particularly relates to communicating a heater enable state and a heater temperature on a single-line data connection at the same time.

BACKGROUND OF INVENTION

It is known that by heating fuel injected into an internal combustion engine during a cold start, particularly fuel comprising alcohol, hydrocarbon (HC) and carbon monoxide (CO) emissions can be reduced. Various arrangements for closed-loop temperature control that use a temperature feedback signal have been proposed. Ground shift errors caused by injector coil current and heater element current make it difficult to accurately determine a temperature feedback signal. One proposed solution is to provide a signal ground wire separate from a power ground wire to provide a Kelvin type connection for the feedback signal to minimize ground shift errors. However, extra wires undesirably increase total system cost. Another proposed solution is to use digital signal communication techniques to avoid the problems caused by ground shift. However, the electronic hardware and associated software necessary for digital data transmission also adds undesirable cost and complexity.

SUMMARY OF THE INVENTION

In accordance with one embodiment of this invention, a system for closed-loop temperature control of a heater element thermally coupled to a heated fuel injector is provided. The system has two-way data communication via a single-line data connection. The system includes a voltage source and a variable current sink. The voltage source is configured to output a heater enable signal on the single-line data connection. The heater enable signal has a voltage value indicative of a heater enable state. The variable current sink is configured to draw a current value from the single-line data connection. The current value is indicative of a temperature value related to the heated fuel injector. The indications of the heater enable state and the temperature value are simultaneously present on the single-line data connection.

In another embodiment of the present invention, a heated fuel injector configured for closed-loop temperature control of a heater element thermally coupled to the heated fuel injector is provided. The heated fuel injector has two-way data communication via a single-line data connection. The heated fuel injector includes a voltage detector and a variable current sink. The voltage detector is configured to detect a voltage value on the single-line data connection. The variable current sink is configured to draw a current value from the single-line data connection. The current value is indicative of a temperature value related to the heated fuel injector. The indications of the heater enable state and the temperature value are simultaneously present on the single-line data connection.

In yet another embodiment of the present invention, a heated fuel injector controller for closed-loop temperature control of a heater element thermally coupled to a heated fuel injector is provided. The heated fuel injector controller has two-way data communication via a single-line data connection. The heated fuel injector controller includes a voltage source and a current detector. The voltage source is configured to output a heater enable signal on the single-line data connection. The heater enable signal has a voltage value indicative of a heater enable state. The current detector is configured to detect a current value on the single-line data connection. The current value is indicative of a temperature value. The indications of the heater enable state and the temperature value are simultaneously present on the single-line data connection.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION OF INVENTION

Figure 1:
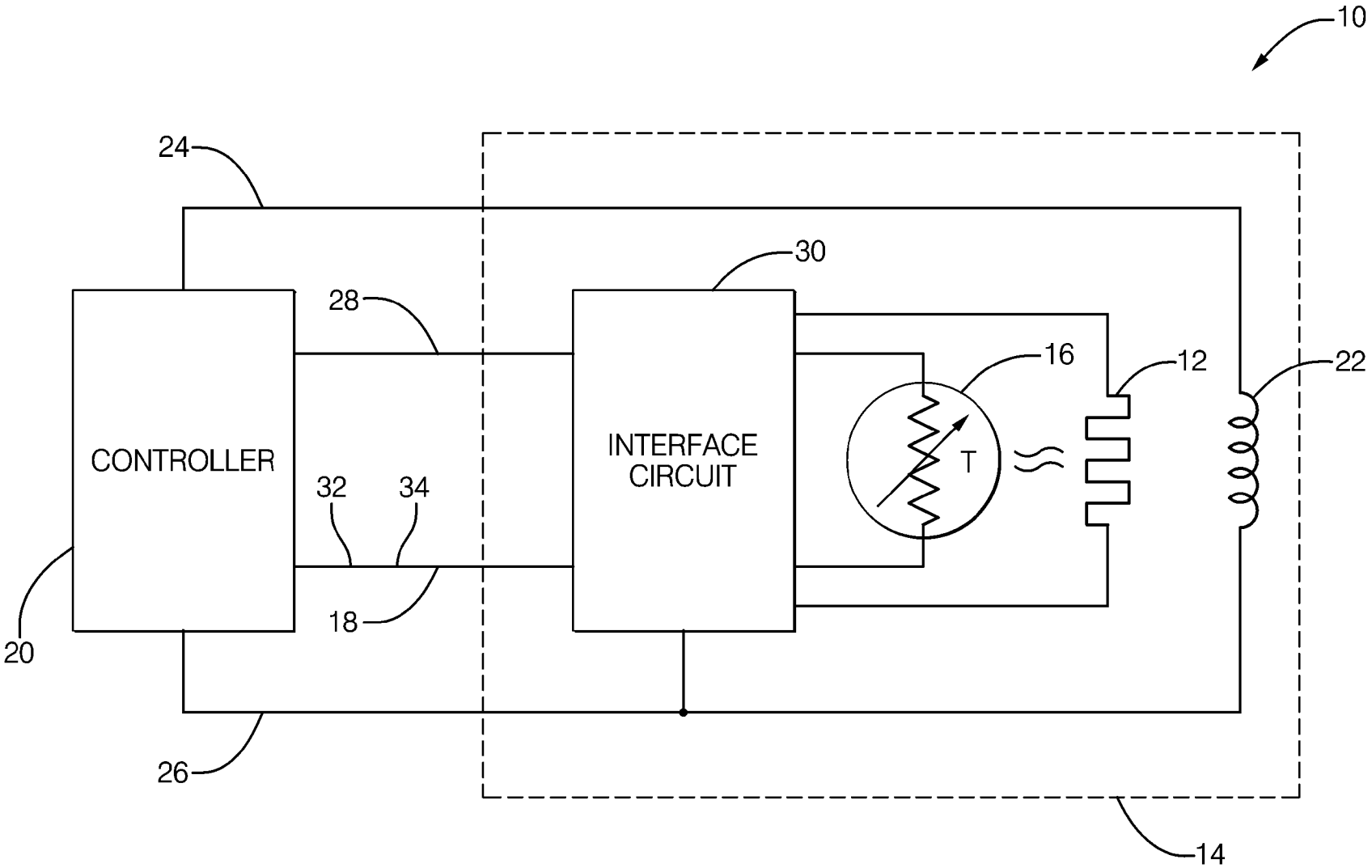
FIG. 1 is a block diagram of a system for closed-loop temperature control of a heater element in a heated fuel injector in accordance with one embodiment.

In accordance with an embodiment, FIG. 1 illustrates a system 10 for closed-loop temperature control of a heater element 12 thermally coupled to a heated fuel injector 14 and a thermistor 16. The heater element 12 may be formed of a metallic material such as metallic foil or wire. The heater element 12 is generally sized and shaped so that the heater element 12 exhibits electrical resistance, and so the heater element generates heat when electrical current passes through the heater element 12. The thermistor 16 may be a device that exhibits an electrical resistance value that varies with temperature, as suggested by the illustration of the thermistor 12. Alternatively, the thermistor 12 may be a solid state device that outputs a signal having a voltage value that varies according to the temperature of the thermistor 16.

The wavy lines between the heater element 12 and the thermistor 16 may suggest that these devices are thermally coupled to each other. The wavy lines may also be interpreted to suggest that these parts are thermally coupled to the heated fuel injector 14 in general, and in particular, thermally coupled to fuel within or passing through the heated fuel injector 14. U.S. patent application Ser. No. 12/773,251 by Kabasin et al. filed May, 4, 2010 describes a non-limiting example arrangement of a heater element and a thermistor as part of a heated fuel injector assembly, the entire contents of which are hereby incorporated by reference herein. As described in more detail below, the system 10 described herein advantageously has simultaneous two-way data communication between a controller 20 and the heated fuel injector 14 for closed-loop control of a temperature related to the heated fuel injector 14 that is via a single-line data connection 18.

The heated fuel injector 14 may include a coil 22 that generates a magnetic field when current is passed through the coil 22 to mechanically operate a fuel valve (not shown) within the heated fuel injector 14 for dispensing fuel, as is well known in the art. Alternatively, the heated fuel injector 14 may use a piezo-electric device instead of the coil 22 to operate the heated fuel injector 14 in response to a voltage being applied to the piezoelectric device. The system 10 is illustrated as having the coil 22 connected to the controller 20 only for the purpose of presenting an example, and not limitation. It is appreciated that the coil 22 may be connected to a separate injection control module (not shown) or the like for operating the fuel dispensing aspect of the heated fuel injector 14. In either case, the coil 22 may connected to an injector control signal 24 and a ground connection 26, where for example the injector control signal 24 is alternatingly connected to a vehicle battery (B+, FIG. 2), or an open circuit in order to operate the heated fuel injector 14 to alternatingly dispense fuel or block fuel from being dispensed.

The controller 20 may also provide a power supply connection 28 that supplies a voltage relative to the ground connection 26 for the purpose of providing electrical power to an interface circuit 30. The non-limiting example of FIG. 1 shows the interface circuit 30 as being part of the heated fuel injector 14. Alternatively, the interface circuit 30 may be a separate module electrically interposed between the controller 20 and the heated fuel injector 14, preferably located near the heated fuel injector 14 so as minimize ground shift problems typically associated with relatively long wires and relatively high currents.

The system 10 may be configured so a heater enable signal 32 is output onto the single-line data connection 18 by the controller 20 to communicate a desired heater enable state (e.g. on-state, off-state) to the interface circuit 30. Also, the system 10 may be configured so a temperature signal 34 is output onto the single-line data connection 18 by the interface circuit 30 to communicate a temperature value to the controller 20. That is, the temperature signal 34 may be interpreted as being indicative of any of: thermistor temperature, heater temperature, injector temperature, fuel temperature, or any other temperature related to the heated fuel injector 14 by compensating the temperature signal 34 for other conditions such as ambient temperature or fuel flow rate. In this way, the controller 20 may be figured to determine whether to apply or interrupt electrical power to the heater element 12 in order to control, for example, the temperature of fuel passing through the heated fuel injector 14 based on a temperature value indicated by the thermistor 16, and so control a temperature in a closed-loop manner using only the single-line data connection 18 for two-way communication.

One way to provide two-way communication over a single wire is to time-multiplex the heater enable signal 32 and the temperature signal 34. The two signals may be analog voltage signals that are time-multiplexed. However, this does not address the ground shift problem described above, and adds undesirable complexity with regard to controlling the timing of the analog signals. Alternatively, the two signals may be digital type signals that are time-multiplexed using known serial communication techniques, and so avoid the ground shift problem, but still add undesirable complexity to the system.

Figure 2:
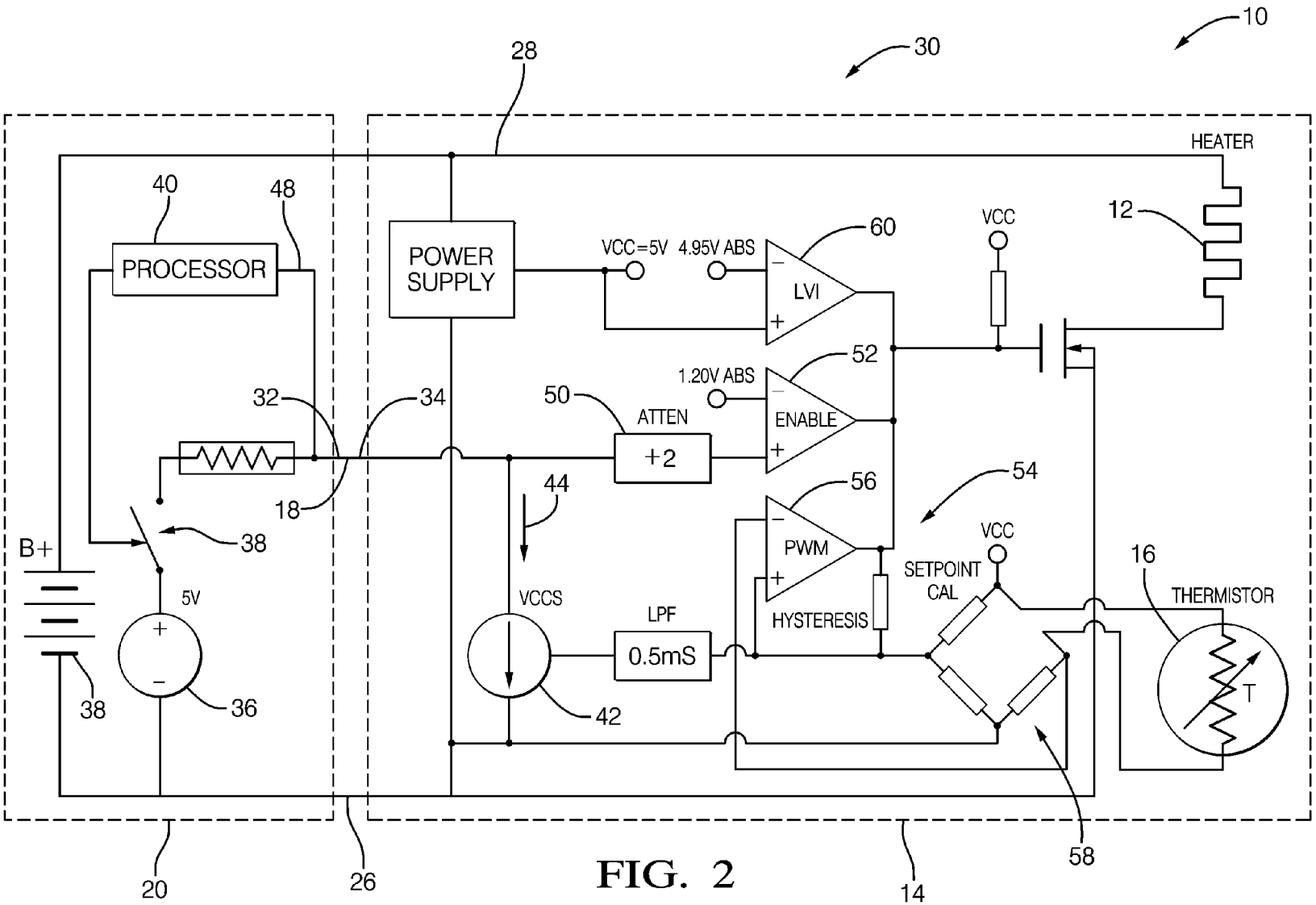
FIG. 2 is a schematic diagram of a system for closed-loop temperature control of a heater element in a heated fuel injector in accordance with one embodiment.

FIG. 2 illustrates a non-limiting example of the system 10 that addresses the temperature signal ground shift problem, and keeps the electronics relatively simple. Note that the coil 22, the injector control signal 24, and the relevant portion of the ground connection 26 that are shown in FIG. 1 are not shown in FIG. 2 only for the purpose of simplifying the illustration, and not limitation. As such, the controller 20 in FIGS. 1 and 2 generally correspond to each other. Also, the circuitry illustrated as being within the heated fuel injector 14 in FIG. 2, except for the heater element 12 and the thermistor 16, illustrate a non-limiting example of the interface circuit 30 of FIG. 1.

FIG. 2 illustrates the controller 20 as having voltage source 36 configured to output a heater enable signal 32 on the single-line data connection 18. In this non-limiting example, the voltage source 36 outputs 5 Volts, and a switch 38 is operated by a processor 40 in order to influence the heater enable signal 32 to indicate if a heater element on-state or a heater element off-state is desired. The voltage source 36 may be a voltage regulator that is well known in the art. The switch 38 may be a mechanical device such as a relay as suggested by the illustration, or the switch 38 may be a solid state type device such as a transistor, a MOSFET for example. The processor 40 may be a microprocessor or other control circuitry as should be evident to those in the art. The controller 20 may also include memory (not shown), including non-volatile memory, such as electrically erasable programmable read-only memory (EEPROM) for storing one or more routines, thresholds and captured data. The one or more routines may be executed by the processor 40 to perform steps for determining signals received by the controller 20 for controlling the heater element 12 as described herein.

The interface circuit 30 may include a variable current sink 42 configured to draw a variable current value 44 from the single-line data connection 18. In this non-limiting example, the variable current sink 42 may be a voltage controlled current source (VCCS), a number of configurations of which are known in the art. FIG. 2 illustrates that the variable current sink 42 or VCCS receives a signal that is based on a resistance value of the thermistor 16. As such, the current value 44 may be indicative of a temperature value related to the heated fuel injector 14, as described above. By using current to communicate the temperature value to the controller 20, the temperature value is not influenced by any ground shifts that may be induced by current through the heater element 12 or the coil 22

The system 10 may include a current detector 46 configured to detect the current value 44. The current detector 46 may be a current sensing device such as a Hall effect sensor, or it may be a resistor as suggested by FIG. 2. If the current detector 46 is a resistor, the processor 40 may determine the current value 44 by measuring a voltage value 48 of the heater enable signal 32 on the single-line data connection 18 relative to a voltage output by the voltage source 36. It is appreciated that current through the current detector 46 may include currents other than the current value 44, for example current into the divide-by-two block 50. As such, it may be necessary for the processor 40 to be configured to compensate the temperature indicated by the current detector 46 so the current value 44 can be accurately determined. Furthermore, the processor 40 may be configured to compensate the temperature indicated by the current detector for time-delay effects due to, for example, thermal time constants of the heated fuel injector 14, variations in ambient temperature, or the cooing effects of fuel flowing through the heated fuel injector 14.

If the current detector 46 is a Hall effect sensor, then the voltage drop across the current detector 46 is expected to be minimal. However, if the current detector 46 is a resistor, then the value of the resistor can be selected so that the voltage drop is substantial, and so the voltage value 48 on the single-line data connection 18 may be simultaneously indicative of both a heater enable state and the temperature value. That is, the indication of the heater enable state and the indication of the temperature value are both present on the single-line data connection 18 at the same instant in time. This arrangement of a voltage source with a substantial series resistor is sometimes described as a weak voltage source because the voltage value 48 may be substantially influenced by the current value 44. By way of example, and not limitation, assume that the current detector 46 is a 2000 Ohm resistor. Also, assume that the interface circuit is configured so the variable current sink 42 draws zero current when the thermistor 16 indicates a temperature less than 30 degrees Celsius, and draws 0.001 Ampere (1 mA) when a temperature is about 150 degrees Celsius. Also, assume that the current draw of the divide-by-two block 50 is negligible, less than 0.001 mA for example. Then the voltage value 48 will be approximately 5.0 Volts when the thermistor 16 indicates a temperature value less than 30 degrees Celsius and the switch 38 is closed. Alternatively, the voltage value will be approximately 3.0 Volts when the thermistor 16 indicates a temperature value of 150 degrees Celsius.

In order to determine the desired heater enable state, the system 10, or more specifically the interface circuit 30, may include a voltage detector 52 configured to detect the voltage value 48. In this non-limiting example, the combination of the divide-by-two block 50 and the voltage detector 52 comparing the output of the divide-by-two block 50 to a reference voltage value of 1.2 Volts is such that if the voltage value 48 is greater than 2.4 Volts, the heater element 12 will receive electrical energy and so generate heat, unless other conditions described below inhibit or otherwise override the heater enable signal 32. For this example, the heater enable signal 32 is interpreted to indicate that the on-state is desired if the voltage value 48 is greater than 2.4 Volts, and the off-state is desired if the voltage value 48 is less than 2.4 Volts. The voltage at which the heater enable signal 32 transitions from one state to the other may be selected based on how much ground shift is expected, the current range of the variable current sink 42, the value of the voltage source 36, or other signal level concerns that would be recognized by those skilled in the art.

Continuing to refer to FIG. 2, the system 10, or interface circuit 30, may also include a temperature limit control circuit 54 configured to override the heater enable signal 32 if the temperature value indicated by the thermistor 16 is greater than a temperature maximum, for example 150 degrees Celsius. Having such a feature helps to protect the heated fuel injector 14 if, for example, the single-line data connection is inadvertently shorted to another voltage source, for example the power supply connection 28. Such a feature could be provided by adding an over-temperature comparator 56, and a Wheatstone bridge arrangement 58 to the interface circuit 30 as illustrated in FIG. 2. In one embodiment, the over-temperature comparator 56 may be configured to latch the heater element 12 to the off-state indefinitely, or until power to the interface circuit 30 is cycled.

In another embodiment, the over-temperature comparator 56 may be configured to have some hysteresis with regard to the temperature value, and so re-enable the heater element 12 back to the on-state (i.e.—stop overriding the heater enable signal) if the temperature value becomes less than a temperature minimum, for example, 100 degrees Celsius. With this arrangement, as illustrated in FIG. 2, the temperature limit control circuit 54 may duty cycle, or pulse-width-modulate (PWM) electrical power to the heater element 12 so that the temperature indicated by the thermistor 16 is maintained between the temperature maximum and temperature minimum. The rate at which power is cycles may be varied by adjusting either the maximum temperature and/or the minimum temperature. It should be recognized that other factors may influence the frequency and percent duty cycle of this temperature limit control circuit 54. For example, lower ambient temperatures and higher fuel flow rates will tend to increase the frequency.

The system 10 may also include a low voltage interrupt (LVI) circuit configured to inhibit heating of the heater element 12 if the voltage on the power supply connection 28 to the interface circuit is less than a threshold, for example less than 5 Volts. Providing such a LVI circuit may be desirable so the heated fuel injector 14 does not draw current from the vehicle electrical system when the voltage of the vehicle electrical system is experiencing low operating voltages, for example when the power supply 28 exhibits a voltage less than 5 Volts.

Accordingly, a system 10 for closed-loop temperature control of a heater element 12 in a heated fuel injector 14, the heated fuel injector 14, and a controller 20 for controlling the heated fuel injector 14 is provided. Controlling the heater element 12 in the heated fuel injector 14 is via a single-line data connection 18 that is a single wire. Indications of the heater enable state in the form of a voltage on the single-line data connection 18 and indications of the temperature value in the form of a current through the single-line data connection 18 are simultaneously present on the single-line data connection 18 at the same instant in time. Furthermore, the system configuration is such that ground shift effect on the accuracy of determining a feedback signal from the heated fuel injector 14 is minimized, where the feedback signal is a temperature value related to the heated fuel injector 14. Because the feedback signal is a current value, the feedback signal is, in general, relatively immune from being influenced by ground shift between the controller 20 and the heated fuel injector 14.

While this invention has been described in terms of the preferred embodiments thereof, it is not intended to be so limited, but rather only to the extent set forth in the claims that follow.

I claim:

1. A system for closed-loop temperature control of a heater element thermally coupled to a heated fuel injector, said system having two-way data communication via a single-line data connection, said system comprising:

a voltage source configured to output a heater enable signal on the single-line data connection, wherein said heater enable signal has a voltage value indicative of a heater enable state; and a variable current sink configured to draw a current value from the single-line data connection, wherein said current value is indicative of a temperature value related to the heated fuel injector, wherein the indications of the heater enable state and the temperature value are simultaneously present on the single-line data connection.

2. The system in accordance with claim 1, wherein said voltage source is a weak voltage source such that the voltage value is influenced by the current value.

3. The system in accordance with claim 2, wherein the weak voltage source comprises a series resistor.

4. The system in accordance with claim 1, wherein said system further comprises a voltage detector configured to detect the voltage value.

5. The system in accordance with claim 1, wherein said system further comprises a current detector configured to detect the current value.

6. The system in accordance with claim 1, wherein said system further comprises a voltage detector configured to detect the voltage value; and a current detector configured to detect the current value.

7. The system in accordance with claim 1, wherein said system further comprises a temperature limit control circuit configured to override the heater enable signal if the temperature value is greater than a temperature maximum.

8. The system in accordance with claim 7, wherein said temperature limit control circuit is further configured to stop overriding the heater enable signal if the temperature value becomes less than a temperature minimum.

9. A heated fuel injector configured for closed-loop temperature control of a heater element thermally coupled to the heated fuel injector, said heated fuel injector having two-way data communication via a single-line data connection, said heated fuel injector comprising:

a voltage detector configured to detect a voltage value on the single-line data connection; and a variable current sink configured to draw a current value from the single-line data connection, wherein said current value is indicative of a temperature value related to the heated fuel injector, wherein the indications of the heater enable state and the temperature value are simultaneously present on the single-line data connection.

10. The heated fuel injector in accordance with claim 9, wherein said heated fuel injector further comprises a temperature limit control circuit configured to override the heater enable signal if the temperature value is greater than a temperature maximum.

11. The heated fuel injector in accordance with claim 10, wherein said temperature limit control circuit is further configured to stop overriding the heater enable signal if the temperature value becomes less than a temperature minimum.

12. A heated fuel injector controller for closed-loop temperature control of a heater element thermally coupled to a heated fuel injector, said heated fuel injector controller having two-way data communication via a single-line data connection, said heated fuel injector controller comprising:

a voltage source configured to output a heater enable signal on the single-line data connection, wherein said heater enable signal has a voltage value indicative of a heater enable state; and a current detector configured to detect a current value on the single-line data connection, wherein said current value is indicative of a temperature value, wherein the indications of the heater enable state and the temperature value are simultaneously present on the single-line data connection.

13. The system in accordance with claim 12, wherein said voltage source is a weak voltage source such that the voltage value arising from the heater enable signal is dependent on a source current output by the weak voltage source.

14. The system in accordance with claim 13, wherein said weak voltage source comprises a voltage source and a series resistor.

* * * * *